US007806305B1

(12) United States Patent
Moore, Jr. et al.

(10) Patent No.: US 7,806,305 B1
(45) Date of Patent: Oct. 5, 2010

(54) TRAVEL TRAY

(76) Inventors: Nathaniel Moore, Jr., 16833 W. South Hampton Rd., Surprise, AZ (US) 85374; Miriam Moore, 16833 W. South Hampton Rd., Surprise, AZ (US) 85374; Lee V Moore, 16833 W. South Hampton Rd., Surprise, AZ (US) 85374

( * ) Notice: Subject to any disclaimer, the term of this patent is extended or adjusted under 35 U.S.C. 154(b) by 870 days.

(21) Appl. No.: 11/703,954

(22) Filed: Feb. 8, 2007

(51) Int. Cl.
*A45F 5/00* (2006.01)

(52) U.S. Cl. ..... 224/265; 224/270; 108/43

(58) Field of Classification Search ..... 224/270, 224/148.4, 148.7, 265, 282; 108/11, 13, 108/139, 43; 312/305
See application file for complete search history.

(56) References Cited

U.S. PATENT DOCUMENTS

| | | | | | |
|---|---|---|---|---|---|
| 1,979,301 | A | * | 11/1934 | Webb | 108/93 |
| 2,312,608 | A | * | 3/1943 | Wadsack | 132/291 |
| 2,685,757 | A | * | 8/1954 | Mirigian | 248/444 |
| 3,061,390 | A | | 10/1962 | Walsh et al. | |
| 4,146,280 | A | * | 3/1979 | Crownhart | 312/305 |
| 4,826,058 | A | * | 5/1989 | Nakayama | 224/554 |
| 4,867,506 | A | * | 9/1989 | Chavez | 297/188.2 |
| 4,946,094 | A | | 8/1990 | Stang | |
| 4,993,611 | A | | 2/1991 | Longo | |
| 5,062,558 | A | | 11/1991 | Stang | |
| 5,074,222 | A | * | 12/1991 | Welch | 108/43 |
| 5,092,652 | A | * | 3/1992 | Macaluso | 297/146 |
| 5,285,940 | A | | 2/1994 | Goulter | |
| D346,310 | S | | 4/1994 | Schlesier et al. | |
| 5,692,815 | A | * | 12/1997 | Murphy | 312/283 |
| D389,665 | S | | 1/1998 | Ackerman | |
| 5,850,956 | A | | 12/1998 | Hayward, Jr. | |
| 5,913,463 | A | | 6/1999 | Carr | |
| 6,095,060 | A | * | 8/2000 | Ma | 108/45 |
| 7,011,363 | B1 | * | 3/2006 | Connery | 297/153 |
| 2008/0296937 | A1 | * | 12/2008 | Cinque | 297/144 |

* cited by examiner

*Primary Examiner*—Justin M Larson

(57) ABSTRACT

The present invention relates to a redesigned food tray that is supported by the user's shoulders. The food tray features a two-part tray system that when folded out resembles a circle. The outer tray of the two-part tray system features two cup holders, and rotates about the center of the two-part tray system. When the outer tray is folded up, the cup holders retract. A bib-like cover attaches to the shoulder straps and prevents food and/or beverages to spill on the end user. The inner tray features a lip, which prevents spill from food and/or beverage to reach the user's lap.

2 Claims, 2 Drawing Sheets

TRAVEL TRAY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of food serving trays, particularly trays for use during travel in an automobile, airplane, or train. The present invention may be used by children, the elderly, or invalids.

This invention directs its use to the above identified people as well as situations, and additionally provides flexibility and adaptability for those situations.

B. Prior Art

The Ackerman patent (U.S. Pat. No. Des. 389,665) illustrates an ornamental design for a portable picnic tray device. However, this patent is not directed to a portable food tray having a rotatable portion that when expanded provides a plurality of fold out cup holders.

The Hayward, Jr. patent (U.S. Pat. No. 5,850,956) discloses a body-worn food tray with cup holders and shoulder straps. However, this patent provides a food eating surface with indentations to accommodate various food and beverage containers, which by itself, is inherently limiting. Furthermore, this patent does not disclose a rotatable portion of the dining surface, which when expanded provides a plurality of cup holders.

The Walsh et al. (U.S. Pat. No. 3,061,390) discloses a tray with a cup holder that is intended to be worn by a person through the use of shoulder attachment means. Again, this patent does not disclose a rotatable portion of the dining surface that when expanded provides a plurality of cup holders.

The Stang patent (U.S. Pat. No. 5,062,558) discloses a food tray and bib system which is adapted to be removably coupled to the neck of a user's body. As mentioned in the above referenced patents, this disposable tray system does not provide the flexibility associated with a rotatable dining surface that when expanded provides a plurality of cup holders.

The Longo patent (U.S. Pat. No. 4,993,611) discloses a support for a beverage container which may be placed around the neck of a user. However, this patent is not directed to a food and beverage tray system that is adapted to be worn about the end user's neck.

The Stang patent (U.S. Pat. No. 4,946,094) discloses a food stuff container system which is adapted to be removably coupled to the body of a user. However, this patent does not disclose a rotatable portion of the dining surface that when expanded provides a plurality of cup holders.

The Schlesier et al. (U.S. Pat. No. Des. 346,310) illustrates a design for a wearer-attachable portable snack tray. This patent does not illustrate a cup holder that descends when a portion of the dining service is rotated to an expanded position.

The Carr patent (U.S. Pat. No. 5,913,463) discloses a cup holder which engages a user's upper chest. As mentioned under the Longo patent, this patent is not directed to a food and beverage tray system with a rotatable portion that when expanded provides a plurality of cup holders.

The Goulter patent (U.S. Pat. No. 5,285,940) discloses a folding neck-supported food tray with elevated cup holder. However, this patent does not disclose a food tray in which a large portion of which can be rotated out to an expanded position thereby procuring a plurality of cup holders.

BRIEF SUMMARY OF THE INVENTION

The present invention relates to a redesigned food tray that is supported by the user's shoulders. The food tray features a two-part tray system that when folded out resembles a circle. The outer tray of the two-part tray system features two cup holders, and rotates about the center of the two-part tray system. When the outer tray is folded up, the cup holders retract. A bib-like cover attaches to the shoulder straps and prevents food and/or beverages to spill on the end user. The inner tray features a lip, which prevents spill from food and/or beverage to reach the user's lap.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
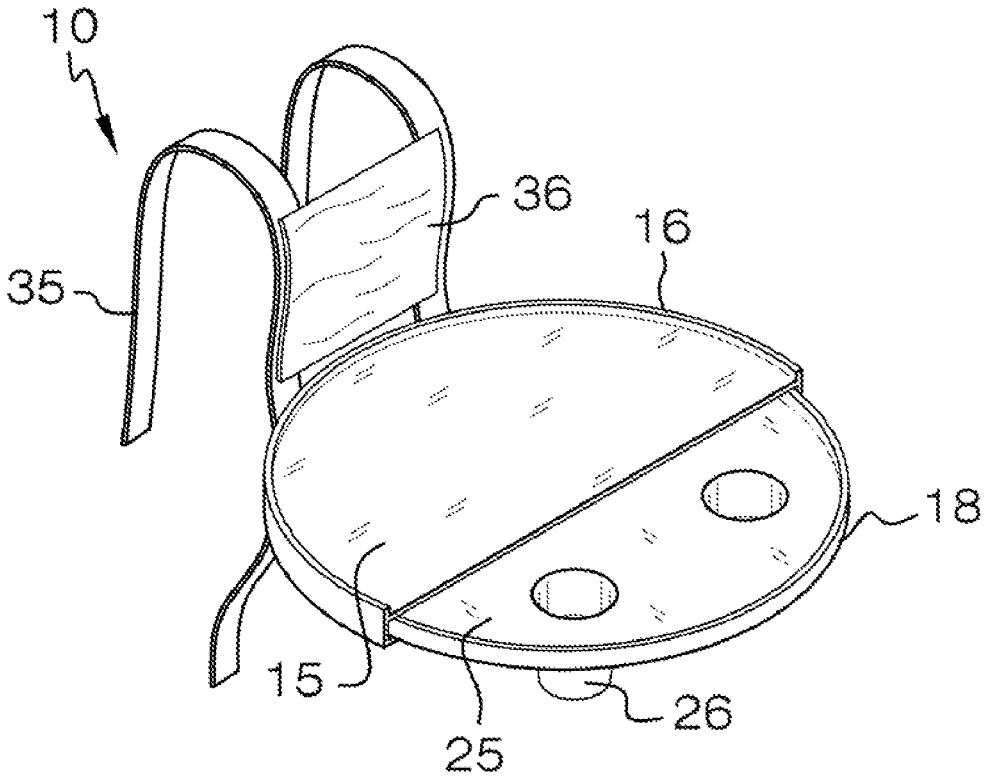
FIG. 1 illustrates an isometric view of the invention by with the outer tray in an extended position.

Detailed reference will now be made to the preferred embodiment of the present invention, examples of which are illustrated in FIGS. 1-5. The invention 10 comprises an inner tray 15, an outer tray 25, a pair of ergonomic shoulder straps 35, a pair of cup holders 26, and a cover 36.

The inner tray 15 has a first lip 16, and attaches to the shoulder straps 35. The lip 16 is to provide a spill proof barrier immediately adjacent to the user's body. The inner tray 15 has a center 17 that protrudes from the underside of the inner tray 15.

The outer tray 25 has a second lip 18 and also has the pair of cup holders 26 that can extend and retract. The cup holders 26 ability to expand and retract enables the end user to securely rest his or her beverage without a great likelihood that the beverage will spill under normal dining situations. The cup holders 26 design is an added benefit to the invention 10 as opposed to a raised circle in the outer tray 25, which would provide little support and stability for a beverage. A raised circle in the outer tray 25 would not likely prevent a beverage spill associated with a minor movement of the invention 10.

Figure 2:
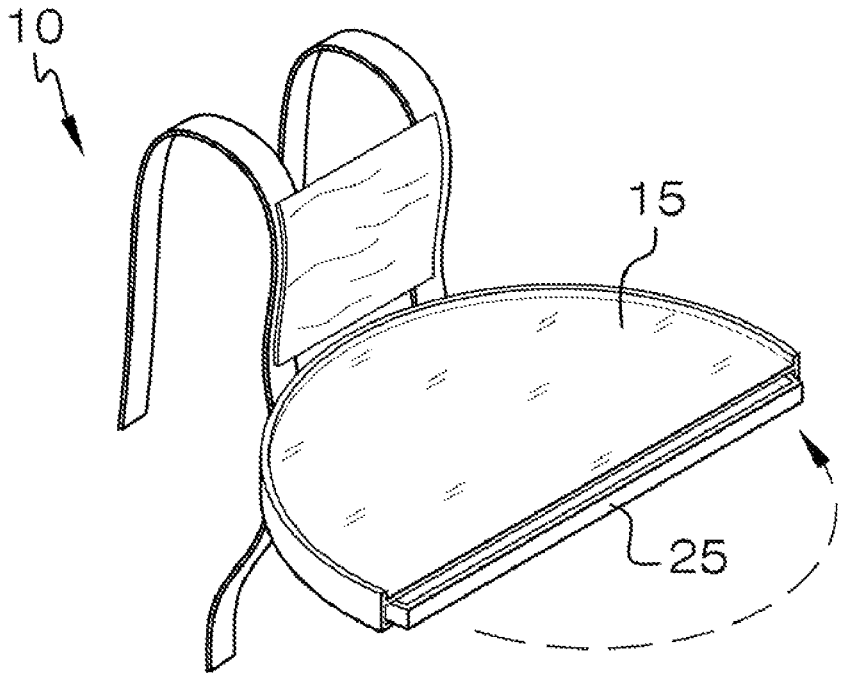
FIG. 2 illustrates an isometric view of the invention with the outer tray in a retracted position.
Figure 3:
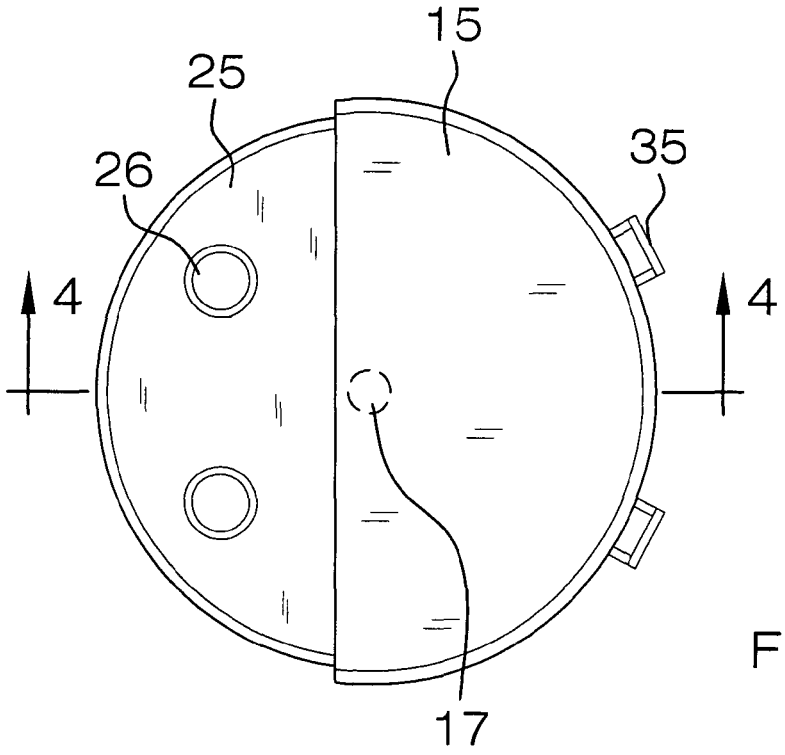
FIG. 3 illustrates a top view of the invention.
Figure 4:
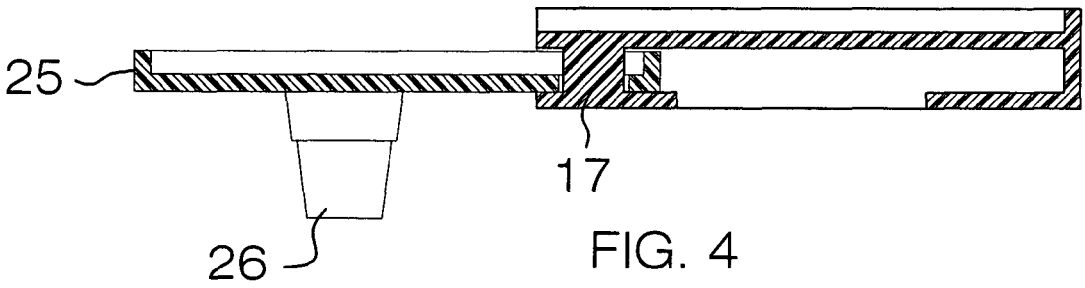
FIG. 4 illustrates a cross-sectional view of the invention with the outer tray folded out with a cup holder in the extended position along line 4-4.
Figure 5:
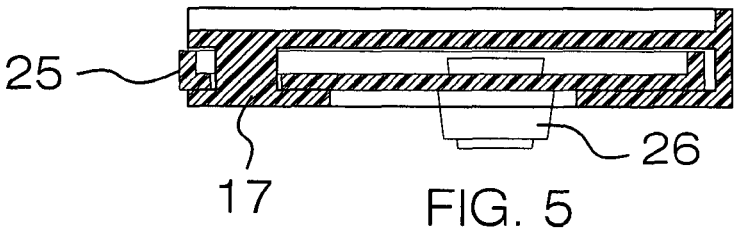
FIG. 5 illustrates a cross-sectional view of the invention with the outer tray folded inward with a cup holder in the retracted position along line 5-5.

The outer tray 25 rotates about the center 17 between the extended and retracted positions as seen in FIGS. 1 and 2, respectively. As seen in FIG. 1, when the outer tray is in the extended position, the inner and outer trays together define a usable circular travel tray surface having a perimeter surrounded by the first and second lips. The outer tray 25 has the ability to rotate 360 degrees about the center 17. The ability of the outer tray 25 to rotate 360 degrees about the center 17 is another design advantage of the invention 10 in that it enables the user to either expand or retract the outer tray 25 by rotational movement to the left or right sides of the outer tray 25.

The cup holders 26 retract, and expand when the outer tray is rotated around to the hidden state and extended state, respectively. The retraction and expansion of the cup holders 26 is another important advantage to the invention 10 in that it enables the invention 10 to be more easily stored when not in use, and when in use will provide more flexibility and less restriction to the end user's lap. To so design otherwise would yield two cup holders that would rub against the lap of the end user, and would create a higher likelihood of interference in use of the invention 10.

The cover 36 prevents accidental spillage from food and/or beverage from reaching the end user. The cover 36 provides another useful advantage to the invention 10, in that it prevents the likelihood of stains to the end user's garments from occurring.

The shape of the shoulder straps 35 provide flexibility in order to accommodate a variety of sizes associated with potential end users. The lower end of the shoulder strap 35 has a slight curvature, which creates more stability for the invention 10 by pressing the abdomen of the end user. A lack of said curvature of the shoulder straps 35 would limit the stability of the invention 10 and would likely result in the invention 10 leaning forward and away from a horizontal position with respect to the torso of the end user. The resulting design of the shoulder straps 35 is to provide added ergonomical advantage over traditional shoulder straps associated with the prior arts.

The inner tray 15, outer tray 25, cup holders 26, shoulder straps 35, and cover 36 are made of a material comprising plastic, wood, and/or metal. Regardless of the material, the invention 10 is designed to be lightweight, ergonomic, and flexible.

The inventor claims:

1. A travel tray comprising:

(a) an inner tray; wherein a first lip runs along only a portion of the perimeter of the inner tray; and wherein a center protrudes from a bottom surface of the inner tray;

(b) an outer tray rotatably connected to the center; wherein a second lip runs along a portion of the perimeter of the outer tray; wherein the outer tray can rotate a full 360 degrees about the center between an extended position and a retracted position; wherein the outer tray, in the extended position, extends away from the inner tray such that the inner tray and outer tray together define a usable travel tray surface, wherein the first and second lips together surround the entire perimeter of the travel tray surface in order to prevent spillage off of the travel tray; and wherein the outer tray, in the retracted position, extends into the inner tray in order to reduce the size of the travel tray for storage;

(c) a plurality of extendable and retractable cup holders integrated into the outer tray; and (d) a pair of shoulder straps attached to the inner tray; wherein a cover is attached to the shoulder straps in order to prevent spillage onto the user.

2. The travel tray as described in claim 1 wherein the shoulder straps, inner tray, outer tray, cup holders, and cover are made of a material comprising plastic, wood, or metal.

* * * * *